US006148546A

United States Patent [19]

Demarchi

[11] Patent Number: 6,148,546

[45] **Date of Patent: *Nov. 21, 2000**

[54] SPORT BOOT

[75] Inventor: Jean-Louis Demarchi, Saint-Jorioz, France

[73] Assignee: Salomon S.A., Metz-Tessy, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/887,945

[22] Filed: Jul. 3, 1997

[30] Foreign Application Priority Data

Jul. 12, 1996 [FR] France ..... 96 09054

[51] Int. Cl.[7] ..... A43B 5/04; A43B 5/16

[52] U.S. Cl. ..... 36/115; 36/117.1; 36/117.3; 36/118.2

[58] Field of Search ..... 36/3 R, 3 A, 27, 36/28, 35 R, 87, 102, 109, 115, 116, 117.1, 117.3, 118.2, 118.9

[56] References Cited

U.S. PATENT DOCUMENTS

| | | | |
|---|---|---|---|
| 4,704,808 | 11/1987 | Bianchini et al. | 36/102 |
| 4,852,275 | 8/1989 | Bianchini et al. | 36/102 |
| 5,171,033 | 12/1992 | Olson et al. | 280/11.22 |
| 5,499,461 | 3/1996 | Danezin et al. | 36/121 |
| 5,797,610 | 8/1998 | Grande et al. | 280/11.22 |
| 5,839,735 | 11/1998 | Benoit | 280/11.22 |

FOREIGN PATENT DOCUMENTS

| | | |
|---|---|---|
| 0261756 | 3/1988 | European Pat. Off. . |
| 2668072 | 4/1992 | France . |
| 29600910 | 3/1996 | Germany . |
| 302731 | 4/1997 | Taiwan . |
| WO94/21149 | 9/1994 | WIPO . |

*Primary Examiner*—Paul T. Sewell
*Assistant Examiner*—Anthony Stashick
*Attorney, Agent, or Firm*—Greenblum & Bernstein, P.L.C.

[57] ABSTRACT

Sport boot, especially for gliding sport, including an external sole adapted to be affixed to a sporting item, and from which an upper covering the foot extends, wherein the upper is composed of two portions the first of which is made of a relatively rigid material constituting a cradle which forms a rear envelope adapted to house the user's heel and is integral with the sole in the heel zone. A second portion of the upper is made of a relatively flexible material constituting a vamp for covering the forefoot of the user, which is adapted to be fixedly fastened to the free front portion of the sole, on the one hand, and to lateral zones of the rear envelope which affixed thereto, on the other hand, via a connection.

22 Claims, 3 Drawing Sheets

SPORT BOOT

BACKGROUND OF THE INVENTION

1. Field of the Invention

The present invention generally relates to a sport boot, for gliding sport or any other sport requiring transmission of specific forces, which is more particularly adapted for skiing on snow, ice skating, or skating on solid ground using conventional roller skates or in-line roller skates.

2. Background and Material Information

For skating, whether on snow, ice or solid ground, the boot generally includes an external sole adapted to be affixed to the upper plate of a frame, on which the wheels are arranged, and from which an upper covering the foot extends in the direction of the skater's ankle.

The problems encountered with these boots adapted to the transmission of forces are due to the fact that they are generally designed according to the technique used for alpine ski boots, i.e., they have a monoblock shell made of a relatively rigid plastic material.

However, a degradation in the rigidity of the shell, caused by more or less high temperature, has been noted, especially in the application to boots for roller skating on solid ground, because this sport is mainly played in fine weather. This phenomenon is further accentuated in regions where temperatures are high.

This loss in the rigidity of the shell is an essential criterion for a good transmission of forces and good stability.

Of course, it would be possible to correct the aforementioned flaw by using materials whose bending modulus is higher, but it would be detrimental to the comfort and qualities for enveloping the foot.

A response to this problem is provided in certain boots by overmolding, in the base of the shell, a rigid insert which tends to compensate for the loss of rigidity caused in the latter by the aforementioned rise in the temperature.

This manufacturing method has proven expensive and not very reactive.

SUMMARY OF THE INVENTION

Therefore, the object of the present invention is to remedy the aforementioned drawbacks, and in particular to reconcile the need for the comfort and the necessary rigidity in certain portions of the boot at minimum costs.

This object is achieved by the present invention which, to this end, relates to a sport boot, especially for gliding sport, having an external sole adapted to be affixed to a sporting item, and from which an upper covering the foot extends, wherein the upper is composed of two portions the first of which is made of a relatively rigid material constituting a cradle which forms a rear envelope adapted to house the user's heel and is integral with the sole in the heel zone. A second portion of the upper is made of a relatively flexible material constituting a vamp for covering the forefoot of the user, which is adapted to be fixedly fastened to the free front portion of the sole, on the one hand, and to lateral zones of the rear envelope which affixed thereto, on the other hand, via connection means.

Such a concept makes it possible, without generally losing the qualities of enveloping and of holding the foot, to have a rigidity in the lower portion of the upper or shell, and an insensitivity to temperature while having an improved comfort and more flexible and less costly manufacturing, making it possible, for example, to modify the characteristics of the front and rear portions of the upper or shell depending on the user and the type of sport.

BRIEF DESCRIPTION OF DRAWINGS

The present invention also relates to the characteristics which will become apparent along the description that follows, and which are to be considered separately or according to all of their possible technical combinations.

This description, which is provided by way of a non-limiting example, will help to better understand how the invention can be embodied, with reference to the annexed drawings, in which.

DETAILED DESCRIPTION OF THE PREFERRED EMBODIMENTS

Figure 1:
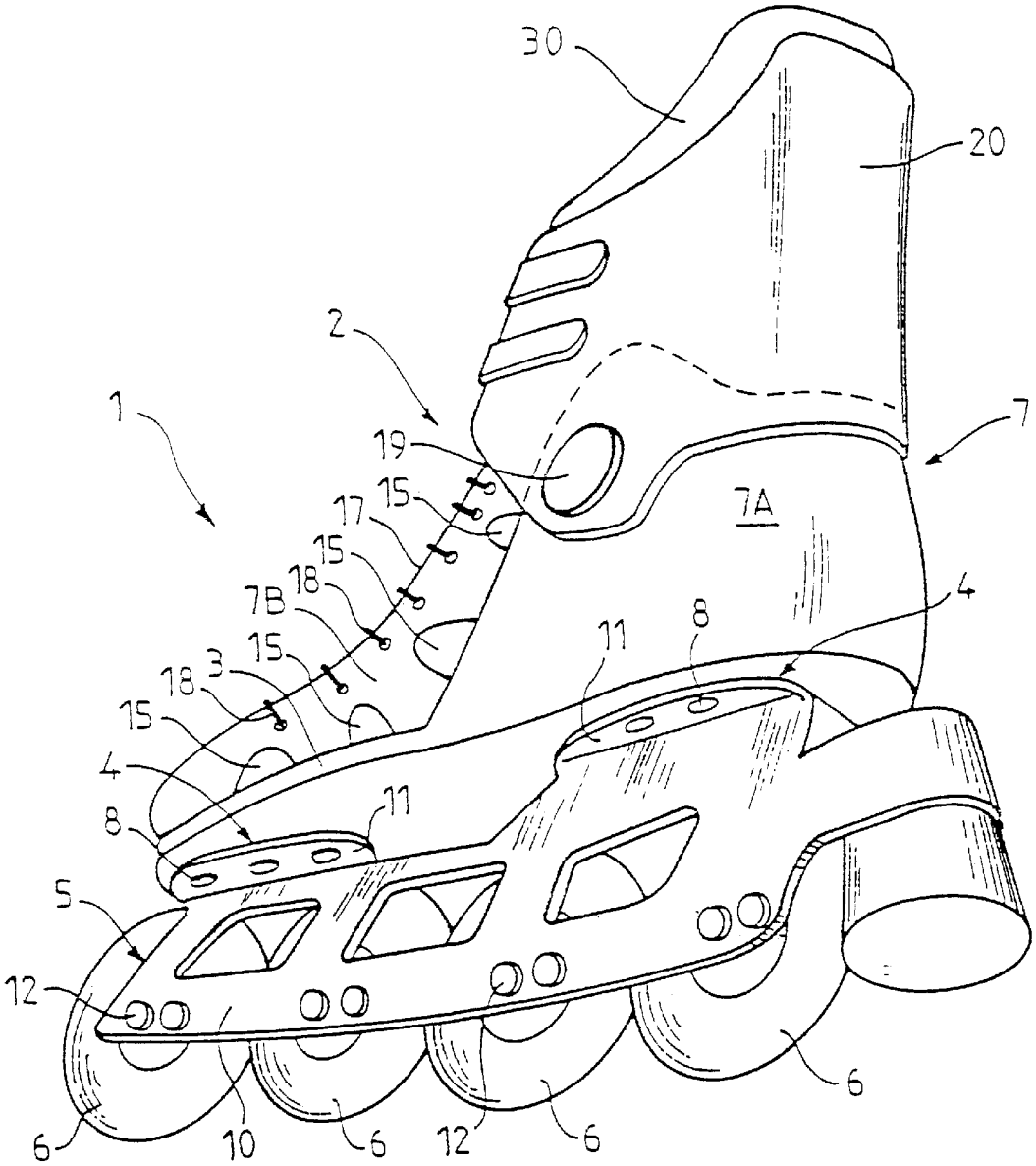
FIG. 1 is a perspective view of an in-line roller skate, cited by way of example, and of a boot attached thereto according to the invention.

The in-line roller skate generally designated by reference numeral 1 and shown in FIG. 1, includes a boot 2 constituted by an external sole 3 extending along the entire length of the boot and adapted to be affixed to the upper plate 4 of a frame 5 on which the wheels 6 are arranged, from which sole 3 an upper 7 covering the entire foot extends in the direction of the skater's ankle, and is extended by a collar 20.

The sole 3 of the boot 2 is affixed to the frame 5 forming the horizontal upper plate 4 on which the sole 3 is attached via binding means which, in this case, are screws 8 extending through the plate 4 to be tightened in the lateral edges of the sole 3.

The frame 5 also includes a lower portion perpendicular to the plate 4 along its longitudinal axis, which is for example constituted by two vertical lateral wings 10 parallel to one another and arranged on both sides of the longitudinal axis.

The lateral wings 10 are respectively extended at their upper portion by a perpendicular return 11, each being directed outward and defining a plane corresponding to the horizontal plate 4.

In this way, the vertical lateral wings 10, together with the sole 3 of the boot 2, generally define an inverted U between the wings of which a plurality of wheels 6 are arranged, as many as four, for example, via transverse journal axes 12, affixed to the frame 4 to constitute a rolling train.

According to the invention, the upper 7/sole 3 assembly is composed of two portions the first 7A/3A, of which is made of a relatively rigid material, and constitutes a cradle which forms a rear envelope 13 adapted to house the heel of the skater and is integral with the sole 3 in this zone. As shown in the drawing, the parts 7A and 3A can be made unitary, i.e., as a single piece.

Furthermore, the sole freely extends forward with respect to the portion 7A of the upper through the sole portion 3A.

A second portion of this upper 7/sole 3 assembly is constituted by a monoblock toe-cap made of a relatively flexible material including a sole portion 3B and a vamp portion 7B adapted to cover the forefoot of the skater. The sole portion 3B is preferably designed as a half-sole adapted to receive the front portion or plantar support zone of the foot. It can also be limited to a peripheral edge of the vamp 7B for its assembly to the sole 3A.

This toe-cap is adapted to be fixedly fastened to the sole portion 3A of the sole 3 through its sole portion 3B, on the one hand, and to the lateral edges 13*a,* or edge portions of the rear envelope 13 of the portion 7A of the upper through its vamp portion 7B, on the other hand, via linkage means 14.

These linkage means 14 for the two portions 7A, 7B, of the upper 7, are interposed between a lower and lateral peripheral edge of the vamp 7B and a corresponding edge 13*a* of the cradle formed by the rear envelope 13 of the sole 3.

According to the present embodiment, the linkage means for the two portions 7A, 7B, of the upper 7 or for the portions 3A and 3B, of the sole 3 are constituted by rivets 14.

Of course, these rivets 14 could perfectly be replaced by glue, ultrasonic welding, a seam, or by any other linkage means.

According to another characteristic of the invention, the vamp 7B for covering the forefoot, includes lateral notches 15 made starting from its lower peripheral edge or sole 3B in the direction of its longitudinal upper axis in order to provide flexibility and ventilation of the upper 7 in a manner of a light sandal.

The notches 15 generate tongues 16 whose free ends 16*a* are adapted to be connected to the corresponding edge of the cradle 7A, 3A and sole portion.

Furthermore, the upper central zone of the flexible vamp 7B includes a longitudinal opening 17 demarcating two transverse flaps provided with tightening means 18 adapted to tighten the foot after introduction in the foot.

Figure 2:
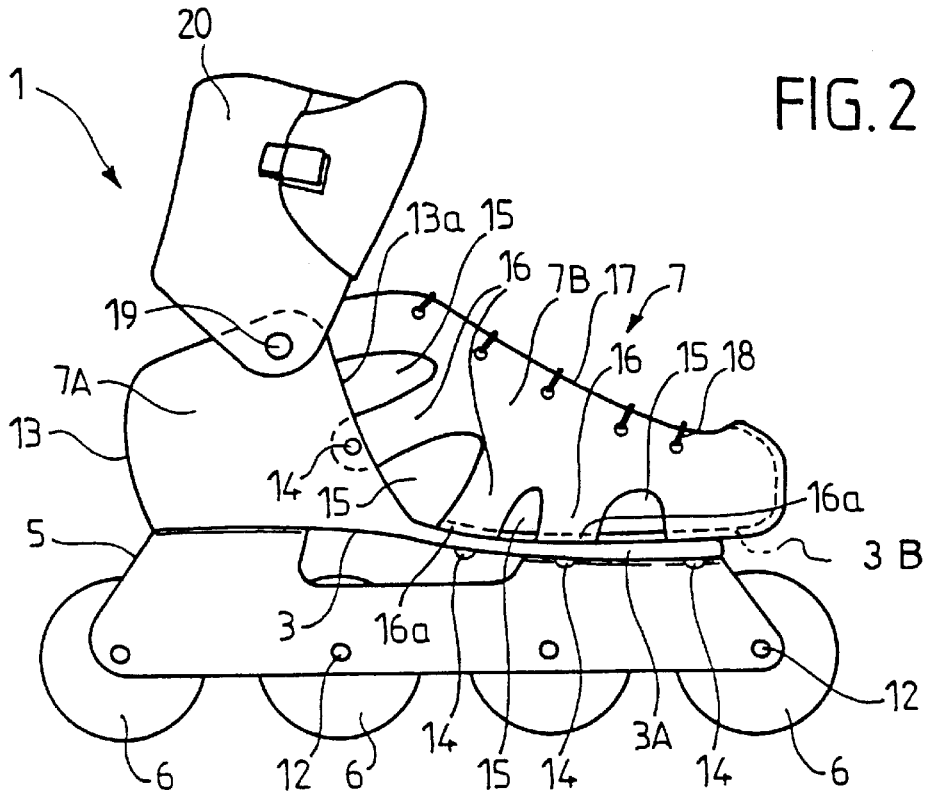
FIG. 2 is a lateral view of a boot and of a skate according to FIG. 1, corresponding to a first example of embodiment of the boot.

As shown in the example of embodiment of FIG. 2, the envelope 13 of the heel constituting the cradle, together with the sole 3, includes lateral zones on which are arranged journal axes 19 of the collar 20 for tightening a lower part of a skater's leg, extending upwardly in the extension of the upper 7 on which it is fixed.

Figure 3:
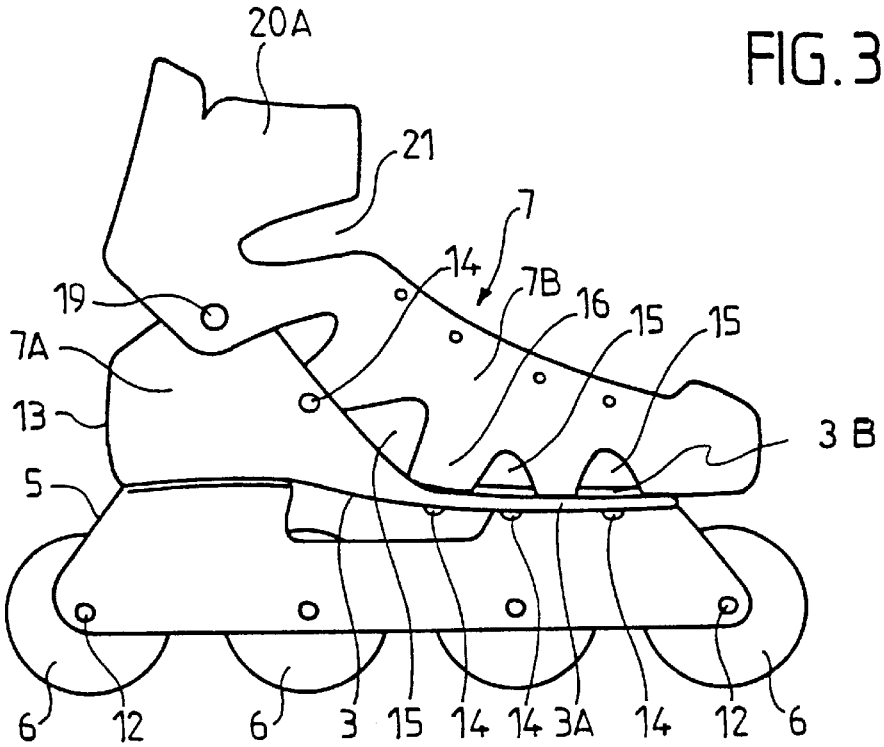
FIG. 3 is a lateral view of a boot according to a second embodiment.

According to an alternative embodiment shown in FIG. 3, the vamp 7B is extended at its upper portion by a collar 20A for tightening a lower part of the leg extending upwardly, beyond the malleoli of the skater, the collar 20A being connected to the envelope 13 of the rigid portion 7A or cradle, by means of journal axes 19 arranged on lateral zones of the envelope 13.

According to this example or embodiment, the design of both the rigid portion 7A forming the cradle and the flexible vamp 7B are identical, and are connected to one another by linkage means that are also identical to the example of embodiment described and illustrated in FIG. 2.

Still according to the example of FIG. 3, it is noted that the collar 20A is made integral with the vamp 7B.

In view of this design, the bending of the collar 20A, with respect to the vamp 7B, is obtained by means of a notch 21 which provides some elasticity of the collar 20A with respect to the vamp 7B, the notch 21 being arranged at the level of the flexion fold of the user's foot.

In either one of the aforementioned examples, the vamp 7B/sole 3B assembly is made out of a sufficiently flexible material to ensure the perfect enveloping of the foot, from the flexion fold of the user'foot to the toe zone. Since the toe-cap does not have to ensure the rigidity and quality of the supports for the foot, it enables low-cost materials to be used, whereas the upper 7/sole 3 assembly is made of a material that is sufficiently rigid and insensitive to the changes in temperature, to ensure the quality of the necessary support for the foot and the transmission of the forces, especially during the thrust phase. As is easily understood, the use of different materials in the two boot portions 7A, 3 and 7B, 3B, respectively, enables a substantial reduction of the manufacturing costs by separating the more technical portions 7A, 3, which require the use of more expensive materials, from the "comfort" portions 7B, 3B, which can be made of less expensive materials.

Figure 4:
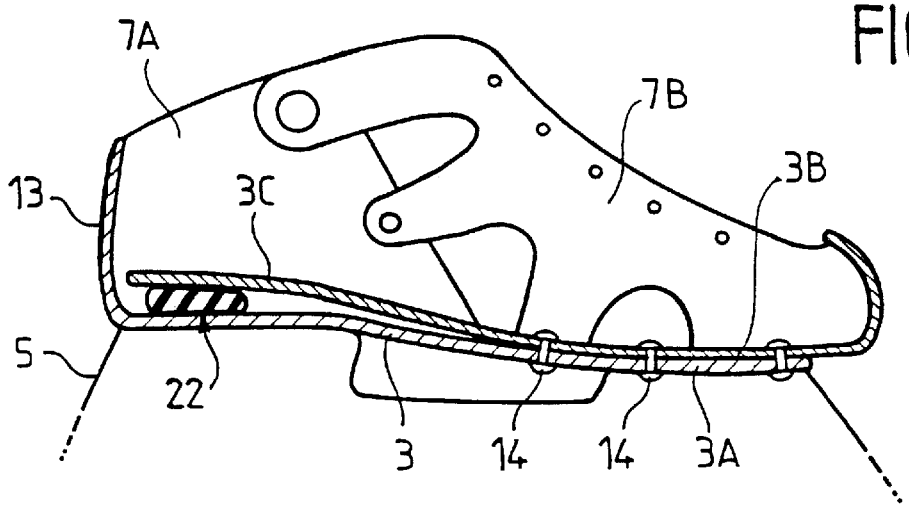
FIG. 4 is a lateral view of a boot according to the example of embodiment of FIGS. 2 and 3, to which a first improvement has been added.
Figure 5:
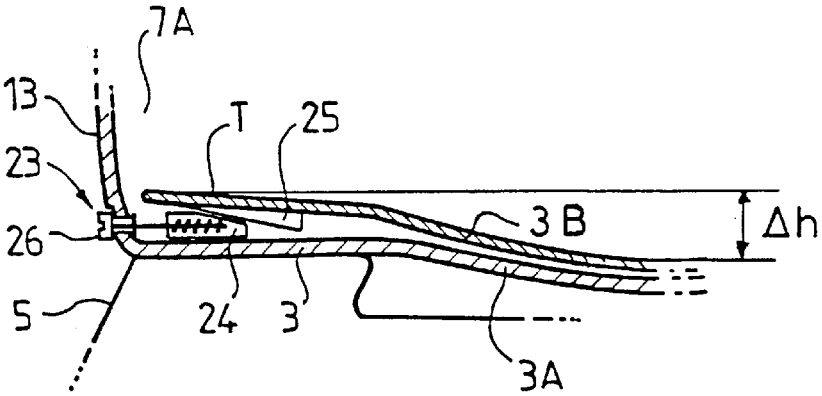
FIG. 5 is a lateral view of a boot according to the example of embodiment of FIGS. 2 and 3, to which a second improvement has been added.
Figure 6:
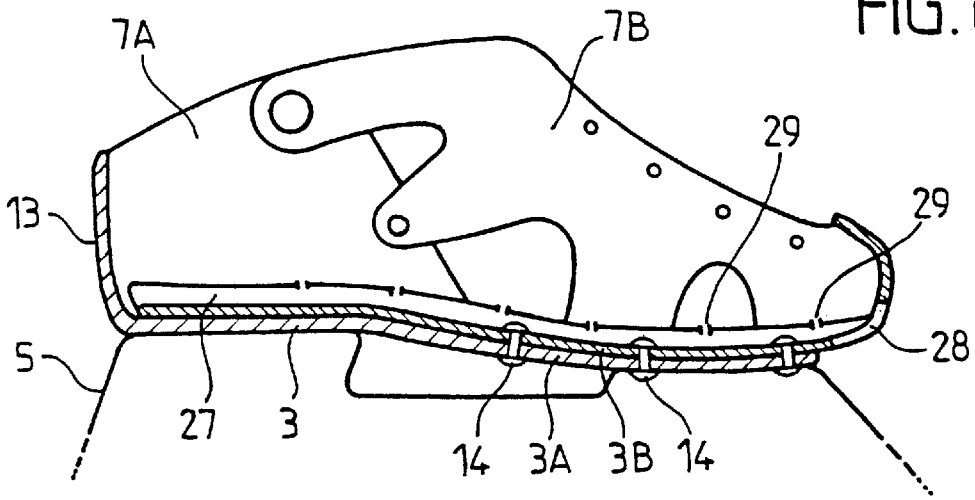
FIG. 6 is a lateral view of a boot according to the example of embodiment of FIGS. 2 and 3, to which a third improvement has been added.

In the examples of embodiment of FIGS. 4, 5 and 6, the vamp 7B for covering the forefoot is closed at its lower portion directed toward the sole 3, by a sole portion 3B which doubles the latter along its entire length and is extended until the heel by a rear portion 3C. The affixation of the sole portion 3A, 3B occurs in the portion 3A of the sole 3, concurrently with the assembly of the portion 7A and the vamp 7B. Conversely, the rear portion 3C of the plantar support 3B remains free in the direction of the envelope 13 of the heel of the rigid cradle 7A with respect to the sole 3.

According to an improvement illustrated in FIG. 4, an antivibrating device 22, constituted by a viscoelastic material, is interposed between the sole 3 coming from the cradle 7A and the rear portion 3C of the plantar support 3B coming from the vamp 7B, at the level of the heel. This enables a shock absorption on a larger zone of the foot.

According to another improvement illustrated in FIG. 5, a device 23 for adjusting the angular position of the skater's foot with respect to the ground, acting on the height difference $\Delta h$ between the support of the heel T and the plantar support 3B of the skater's foot, is interposed between the sole 3 coming from the cradle 7A and the rear portion 3C of the plantar support 3B coming from the vamp 7B, at the level of the heel.

According to this same example or embodiment of FIG. 5, the adjusting device 23 is constituted by a shim 24, interposed between the sole 3 of the rigid cradle 7A and a corresponding portion 25 obtained beneath the rear portion 3C of the plantar support 3B coming from the vamp 7B. The shim 24 is capable of being activated in a longitudinal direction by means of a control member 26 extending through a rear portion of the envelope 13 and taking support on the latter.

Of course, other means for adjusting the height difference $\Delta h$ between the support of the heel T and the sole portion 3B could be provided.

According to an improvement illustrated in FIG. 6, the plantar support 3B coming from the vamp 7B defines longitudinal ribs 27 that are open upwardly, and a zone 28 for the external collection of air is arranged at the front of the vamp 7B, relative to the ribs 27 which constitute means for the passage of air toward the internal volume of the upper 7 with which they communicate. FIG. 6 also shows, schematically, the option of air passages 29 which could be provided in an insole for air ventilation to the internal volume of the upper.

According to all the examples of embodiment illustrated in FIGS. 1–6, the vamp 7B is made out of a relatively flexible material and is integral with the sole portion 3B. It can also be made, at least partially, of fabric.

It must be noted that the fabric can have wide meshes forming a net.

According to the same examples of embodiment of the Figures, the cradle 7A is made of a rigid plastic material.

Still according to these same examples, within the upper 7 is an internal comfort element 30. This comfort element can be a removable monoblock liner.

The instant application is based upon French Priority Patent Application No. 96.09054, filed on Jul. 12, 1996, the disclosure of which is hereby expressly incorporated by reference thereto, and the priority of which is hereby claimed under 35 U.S.C. §119.

What is claimed:

1. A sport boot for a gliding sport, said sport boot comprising:

an upper comprising a relatively rigid portion and a relatively flexible portion;

said rigid portion comprising a cradle and an external sole at least extending forwardly from said cradle, said cradle having a shape for extending laterally around and for receiving a heel of a wearer's foot, said cradle extending forwardly to have lateral edge portions, said cradle being integral with said external sole;

said flexible portion constituting an external vamp having a shape for covering a forefoot of the wearer, said flexible portion being secured to said rigid portion at said external sole and at said lateral edge portion of said cradle; and an internal comfort element positioned internally of said upper, said internal comfort element comprising a liner of said upper.

2. A sport boot according to claim 1, wherein:

said cradle and said external sole are unitary.

3. A sport boot according to claim 1, wherein:

said flexible portion is secured to said rigid portion with means for connecting said flexible portion and said rigid portion.

4. A sport boot according to claim 3, wherein:

said flexible portion comprises a lower and lateral peripheral edge portion and said external sole comprises a peripheral edge portion at least forward of said cradle; and said flexible portion and said rigid portion are secured by said connecting means interposed between (a) said lower and lateral peripheral edge portion of said flexible portion and (b) said lateral edge portion of said cradle and said peripheral edge portion of said external sole.

5. A sport boot according to claim 4, wherein:

connecting means is constituted by rivets.

6. A sport boot according to claim 4, wherein:

connecting means is constituted by seams.

7. A sport boot according to claim 1, wherein:

said cradle and said vamp constitute an upper of the boot; and said external sole comprises a peripheral edge portion at least forward of said cradle;

said vamp comprises a lower lateral peripheral edge portion, a plurality of longitudinally spaced series of lateral notches being formed at least in said lower lateral peripheral edge portion of said vamp for obtaining flexibility and ventilation of said upper, said lateral notches being separated by tongues having free ends connected to said lateral edge portion of said cradle and said peripheral edge portion of said external sole.

8. A sport boot according to claim 1, wherein:

said vamp comprises a longitudinal opening demarcated by two transverse flaps provided with tightening means to tighten the boot to the foot of the wear.

9. A sport boot according to claim 1, wherein:

said cradle and said vamp constitute an upper of the boot; and said upper further comprises a collar to extend around and be tightened to a lower part of a leg of the wearer, said collar extending upwardly from said cradle, said collar being affixed to said cradle by journal axles.

10. A sport boot according to claim 1, wherein:

said cradle and said vamp constitute an upper of the boot; and said upper further comprises a collar to extend around and be tightened to a lower part of a leg of the wearer, said collar extending upwardly from said cradle above a malleoli of the wearer, said collar being affixed to said cradle by journal axles on lateral portions of said cradle.

11. A sport boot for a gliding sport, said sport boot comprising:

an upper comprising a relatively rigid portion and a relatively flexible portion;

said rigid portion comprising a cradle and an external sole at least extending forwardly from said cradle, said cradle having a shape for extending laterally around and for receiving a heel of a wearer's foot, said cradle extending forwardly to have lateral edge portions, said cradle being integral with said external sole;

said flexible portion constituting an external vamp having a shape for covering a forefoot of the wearer, said flexible portion being secured to said rigid portion at said external sole and at said lateral edge portion of said cradle;

an internal comfort element positioned internally of said upper, said internal comfort element comprising a liner of said upper;

said flexible portion further comprising a plantar support closing a bottom part of said vamp, said plantar support extending at least along an entire length of said external sole, said plantar support being affixed to said external sole only at said portion of said external sole extending forwardly of said cradle.

12. A sport boot according to claim 11, further comprising:

a viscoelastic material, constituting an anti-vibration device, interposed between respective rear portions of said external sole and said plantar support.

13. A sport boot according to claim 11, further comprising:

a device for adjusting an angular position of the wearer's foot with respect to the ground, said device being interposed between respective rear portions of said external sole and said plantar support.

14. A sport boot according to claim 11, wherein:

said plantar support is comprised by a plurality of upwardly open longitudinally extending ribs, the boot further comprising a zone for collecting external air and for communicating said external air between said plurality of upwardly open longitudinally extending ribs.

15. A sport boot according to claim 1, wherein:

said flexible portion further comprises a plantar support secured to a bottom part of said vamp and to at least a portion of said external sole, said plantar support extending forwardly from a forwardmost part of said external sole to form a toecap.

16. An item for a gliding sport comprising a sport boot according to claim 1, further comprising:

a gliding device affixed to said external sole.

17. An item for a gliding sport according to claim 16, said gliding sport comprising an in-line roller skate, wherein:

said gliding device comprises a frame affixed to said external sole of said boot and a plurality of in-line wheels affixed to said frame.

18. A sport boot for a gliding sport, said sport boot comprising:

an upper comprising a relatively rigid portion and a relatively flexible portion;

said rigid portion comprising a cradle and an external sole at least extending forwardly from said cradle, said cradle having a shape for extending laterally around and for receiving a heel of a wearer's foot, said cradle extending forwardly to have lateral edge portions, said cradle being integral with said external sole;

said flexible portion constituting an external vamp having a shape for covering only a forefoot of the wearer, said external vamp being secured to said external sole, said external vamp further being secured to said cradle only at said lateral edge portion of said cradle; and a removable liner, said removable liner comprising an internal monoblock liner of said upper positioned internally of and not otherwise affixed to said upper.

19. A sport boot according to claim 18, wherein:

said cradle and said external sole are unitary.

20. A sport boot according to claim 18, further comprising:

a plantar support closing a bottom part of said vamp and being positioned above said external sole, said plantar support comprising a plurality of upwardly open longitudinally extending ribs, the boot further comprising a zone for collecting external air and for communicating said external air between said plurality of upwardly open longitudinally extending ribs.

21. An item for a gliding sport comprising a sport boot according to claim 18, further comprising:

a gliding device affixed to said external sole.

22. An item for a gliding sport according to claim 21, said gliding sport comprising an in-line roller skate, wherein:

said gliding device comprises a frame affixed to said external sole of said boot and a plurality of in-line wheels affixed to said frame.

* * * * *